United States Patent [19]

Roper et al.

[11] 4,384,625

[45] May 24, 1983

[54] REDUCTION OF THE FRICTIONAL COEFFICIENT IN A BOREHOLE BY THE USE OF VIBRATION

[75] Inventors: Wilbur F. Roper, Dallas; Thomas B. Dellinger, Duncanville, both of Tex.

[73] Assignee: Mobil Oil Corporation, New York, N.Y.

[21] Appl. No.: 210,912

[22] Filed: Nov. 28, 1980

[51] Int. Cl.[3] ..... E21B 31/00; E21B 17/00

[52] U.S. Cl. ..... 175/56; 175/61; 166/301

[58] Field of Search ..... 175/325, 55, 56, 61, 175/298, 296, 293, 107, 137; 166/301

[56] References Cited

U.S. PATENT DOCUMENTS

| | | | |
|---|---|---|---|
| 2,271,005 | 1/1942 | Grebe | 175/325 |
| 2,730,176 | 1/1956 | Herbold | 166/301 |
| 2,972,380 | 2/1961 | Bodine, Jr. | 166/301 |
| 3,049,185 | 8/1962 | Herbold | 175/55 |
| 3,132,707 | 5/1964 | Alexander | 166/301 |
| 3,152,642 | 10/1964 | Bodine, Jr. | 166/301 |
| 3,168,140 | 2/1965 | Bodine, Jr. | 166/301 |
| 3,191,683 | 6/1965 | Alexander | 166/301 X |
| 3,360,056 | 12/1967 | Bodine, Jr. | 175/55 |
| 4,058,163 | 11/1977 | Yandell | 175/55 X |
| 4,243,112 | 1/1981 | Sartor | 175/329 X |

FOREIGN PATENT DOCUMENTS

| | | | |
|---|---|---|---|
| 586125 | 11/1959 | Canada | 175/56 |
| 2545831 | 4/1979 | Fed. Rep. of Germany | 175/107 |

*Primary Examiner*—Ernest R. Purser
*Assistant Examiner*—Joseph Falk
*Attorney, Agent, or Firm*—C. A. Huggett; M. G. Gilman; J. F. Powers, Jr.

[57] ABSTRACT

A deviated borehole is drilled with a rotary drilling technique in which the drill string is vibrated at a suitable frequency and amplitude to reduce the friction of the drill string against the lower side of the borehole and to promote the free movement of the drill string therein.

4 Claims, 2 Drawing Figures

REDUCTION OF THE FRICTIONAL COEFFICIENT IN A BOREHOLE BY THE USE OF VIBRATION

BACKGROUND OF THE INVENTION

Field of the Invention

The present invention relates generally to a method and apparatus for drilling deviated wellbores, such as in extended reach drilling. In greater detail, the present invention is concerned with rotary drilling of a deviated borehole, and is directed to vibrating the drill string at a suitable frequency and amplitude to reduce the friction of the drill string against the lower side of the borehole and to promote the free movement of the drill string in the borehole.

Extended Reach Drilling is concerned with rotary drilling procedures to drill, log and complete wellbores at significantly greater inclinations and/or over horizontal distances substantially greater than currently being achieved by conventional directional drilling practices. The success of extended reach drilling should benefit mainly offshore drilling projects as platform costs are a major factor in most offshore production operations. Extended reach drilling offers significant potential for (1) developing offshore reservoirs not otherwise considered to be economical, (2) tapping sections or reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle extended reach directional drilling. In greater particularity, hole inclinations of 60° or greater, combined with long sections of hole or complex wellbore profiles present significant problems which need to be overcome in extended reach drilling. The force of gravity, coefficients of friction, and mud particle settling are the major physical phenomena of concern.

As inclination increases, the available weight from gravity to move the pipe or wireline string down the hole decreases as the cosine of the inclination angle, and the weight lying against the low side of the hole increases as the sine of the inclination angle. The force resisting the movement of the drill string is the product of the apparent coefficient of friction and the sum of the forces pressing the string against the wall. At an apparent coefficient of friction of approximately 0.58 for a common water base mud, drill strings tend to slide into the hole at inclination angles up to approximately 60°. At higher inclination angles, the drill strings will not lower from the force of gravity alone, and must be mechanically pushed or pulled, or alternatively the coefficients of friction can be reduced. Since logging wirelines cannot be pushed, conventional wireline logging is one of the first functions to encounter difficulties in this type of operation. In such cases it becomes very difficult to push pipe or logging tools into the hole, or to obtain weight-on-the-bit from drill collars.

Hole cleaning also becomes more of a problem in high angle bore holes because particles need fall only a few inches to be out of the mud flow stream and to come to rest on the low side of the hole, usually in a flow-shaded area alongside the pipe. This problem is also encountered in substantially vertical wellbores but the problem is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe when a porous formation is penetrated that has internal pressures less than the pressures existing in the borehole. This settling of cuttings is particularly significant in the near horizontal holes expected to be drilled in extended reach drilling.

If differential pressure (borehole mud pressure less formation pore pressure) exists opposite a permeable zone in the formation, then conditions are present for the pipe to become differentially wall stuck. The pipe is partially buried and bedded into a mass of solids, and can be hydraulically sealed to such an extent that there is a substantial pressure difference in the interface of the pipe and the wall and the space in the open borehole. This hydraulic seal provides an area on the pipe for the pressure differential to force the pipe hard against the wall. The frictional resistance to movement of the pipe against the wall causes the pipe to become immovable, and the pipe is in a state which is commonly referred to as differentially stuck.

Pressure-differential sticking of a drill pipe is also discussed in a paper entitled "Pressure-Differential Sticking of Drill Pipe and How It Can Be Avoided Or Relieved" by W. E. Helmick and A. J. Longley, presented at the Spring Meeting of the Pacific Coast District, Division of Production, Los Angeles, Calif., in May 1957. This paper states that the theory of pressure-differential sticking was first suggested when it was noted that spotting of oil would free pipe that had stuck while remaining motionless opposite a permeable bed. This was particularly noticeable in a field wherein a depleted zone at 4300 feet with the pressure gradient of 0.035 psi per foot was penetrated by directional holes with mud having hydrostatic gradients of 0.52 psi per foot. In view thereof, it was concluded that the drill collars lay against the filter cake on the low side of the hole, and that the pressure differential acted against the area of the pipe in contact with the isolated cake with sufficient force that a direct pull could not effect release. This paper notes that methods of effecting the release of such a pipe include the use of spotting oil to wet the pipe, thereby relieving the differential pressure, or the step of washing with water to lower the pressure differential by reducing the hydrostatic head. Field application of the principles found in a study discussed in this paper demonstrate that the best manner for dealing with differential sticking is to prevent it by the use of drill collar stabilizers or, more importantly, by intentionally shortening the intervals of time when pipe is at rest opposite permeable formations.

Brooks U.S. Pat. No. 3,235,014 describes a surface-mounted vibratory type apparatus which may be used with conventional rotary equipment for the drilling of boreholes. The system herein employs a novel form of swivel which causes a kelly, as it is turned by the rotary table, to be vibrated longitudinally and thereby provide combined rotary and vibratory drilling action to a drill string. This swivel can be designed to impart vibrations of desired amplitude and frequency to the kelly and attached drill string. However, the teachings of this patent are not at all concerned with problems of promoting the movement of a drill string in deviated holes, such as are encountered in extended reach drilling, or with mitigating pressure-differential sticking of a drill string in a deviated wellbore.

Solum U.S. Pat. No. 3,557,875 is directed to apparatus for vibrating a well casing through manipulation of the drill pipe during a procedure wherein such vibration is desired. The device therein is adapted to be mounted on a drill pipe and inserted in a well casing, and includes a radially movable impact member resiliently urged into engagement with the well casing. It is repeatedly moved away from engagement and released to cause an impact upon rotation of the drill pipe while the device is resiliently held from rotating relative to the casing. A method is disclosed of cementing or gravel packing the casing in the well by the use of such devices to vibrate the casing while the cement slurry or gravel is pumped through the drill pipe and into the annulus surrounding the casing. A further example therein of where such vibration is desired is in the running of casing in a slant well wherein in the wellbore starts out vertically, is deviated, and then by a second deviation is returned to the vertical or to a slightly inclined direction. A plurality of casing impacting and vibrating devices are mounted in spaced relation along a length of casing attached to the drill pipe and within a larger diameter casing. Rotation of the drill pipe actuates the devices, and vibrates the larger casing. This patent is also not concerned with problems of promoting the movement of a drill string in deviated holes, such as are encounted in extended reach drilling, or with mitigating pressure-differential sticking of a drill string in a deviated well bore such as in extended reach drilling.

SUMMARY OF THE INVENTION

An object of the present invention is to substantially extend the range of directionally-drilled wells in what is now termed extended reach drilling. The present invention alleviates the problem of sticking of a drill string in a borehole in drilling of this nature by reducing the apparent friction thereof and promoting the free movement of the drill string by vibrating it at a suitable frequency and amplitude. The vibratory motion of the pipe drastically reduces the adhesion between the mud fluid and the pipe, and also breaks down the gel strength of the mud which tends to resist movement of the pipe. Vibration of the drill string elements fluidizes the mass of solids and breaks up gelled volumes of mud and cuttings, which are then moved more efficiently by the circulating drilling mud. Both actions, stirring and breaking up the gels, results in more effective borehole cleaning. The net result is a reduction in the apparent coefficient of friction. In one embodiment of the present invention, the vibratory motion of the pipe is obtained by hydraulically driven vibrators mounted in subs located at suitable positions along the drill string. The hydraulic vibrators are operated by circulation of the drilling fluid at the appropriate rate and pressure. Another embodiment imposes vibratory motion on the drill string with a mechanical vibrator unit attached to the top of the drill stem. A similar system is presently used to drive pilings through compacted soils by tuning the vibrator to the resonant frequency of the vibrator-pipe system. In accordance with the teachings herein, the combination of a mechanical vibrator and a drill string is tuned to a frequency at which vibratory motion is transmitted down a long string of pipe with enough amplitude to accomplish a significant reduction in the effective frictional coefficient. In some embodiments the vibrator assembly may be combined with the elevators to lower the pipe without having to circulate drilling fluid.

Accordingly, it is an object of the present invention to provide a method and apparatus for applying vibratory energy to a drill string. It is another object of the invention to provide vibratory type drilling apparatus which can be readily used with presently known rotary drilling elements to mitigate sticking, particularly pressure differential sticking, of the drill string. In accordance with the teachings herein, a wellbore is drilled by rotating a drill string comprised of sections of drill pipe connected together, and the tendency of the drill string to stick in the hole is mitigated by vibrating the drill string at a suitable frequency and amplitude to reduce the friction of the drill string against the lower side of the borehole. Furthermore, the vibrations promote free movement of the drill string in the borehole, and accordingly mitigate differential sticking of the drill string in the hole. In greater detail, the method of rotary drilling disclosed herein is particularly applicable to extended reach drilling wherein the wellbore being drilled has an inclination from a vertical of at least 60°.

In accordance with one disclosed embodiment of the present invention the drill string is vibrated by hydraulically driven vibrators in subs located at spaced positions along the drill string, and the hydraulically driven vibrators are powered by circulating drilling mud.

In accordance with a second disclosed embodiment of the present invention, the drill string is vibrated with a mechanical vibrator attached to the top of the drill string. In each of the disclosed embodiments, the drill string may be vibrated at the resonant or natural frequency of the system.

BRIEF DESCRIPTION OF THE DRAWINGS

The foregoing and other objects and advantages of the inventive arrangement for reducing the differential pressure sticking tendency of a drill string may be more readily understood by one skilled in the art, having reference to the following detailed description of several preferred embodiments, taken in conjunction with the accompanying drawings wherein identical reference numerals refer to like elements throughout the several views, and in which.

DETAILED DESCRIPTION OF THE DRAWINGS

Figure 1:
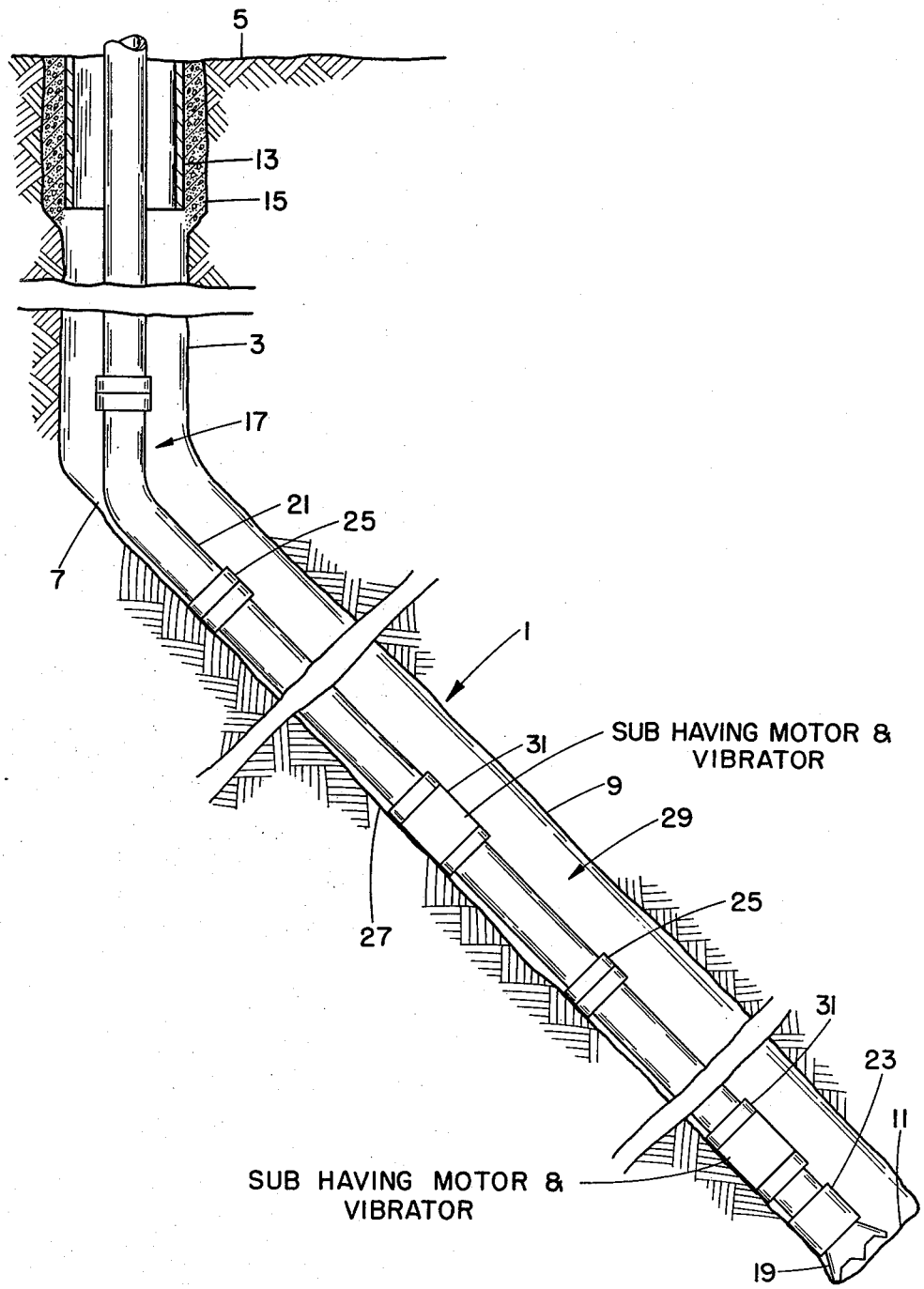
FIG. 1 is a schematic drawing of a deviated wellbore extending into the earth, and illustrates one disclosed embodiment of the present invention.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit, and to form a tensile member to pull the drill string from the wellbore. In normal operations, a drill pipe is always in tension during drilling operations. Drill pipe commonly varies from 3½" to 5" in outside diameter, and is normally constructed of steel. However, aluminum drill pipe is also available commercially, and may be an attractive option for extended reach drilling as it would reduce the weight of the drill string against the side of a high angle hole.

Commercially available 4½ inch, aluminum drill pipe with steel tool joints should exert only about one third the wall force due to gravity on the low side of an inclined hole in a 14 ppg mud as does a similar steel string. Theoretically, for frictional forces, one third the wall force would then produce one third the drag and one third the torque of a comparable steel drill string. Moreover, a commercial aluminum drill string compares favorably with a steel drill string regarding other physical properties.

Drill collars are thick-walled pipe compared to drill pipe and thus are heavier per linear foot than drill pipe. Drill collars act as stiff members in the drill string, and are normally installed in the drilled string immediately above the bit and serve to supply weight on the bit. In common rotary drilling techniques, only the bottom three-fourths of the drill collars are in axial compression to load the bit during drilling, while about the top one-fourth of the drill collars are in tension, as is the drill pipe. The drill collars used in conducting rotary drilling techniques are of larger diameter than the drill pipe in use, and normally are within the range of 4½" to 10" in outside diameter.

Tool joints are connectors for interconnecting joints of drill pipe, and are separate components that are attached to the drll pipe after its manufacture. A tool joints is comprised of a male half or pin end that is fastened to one end of an individual piece of pipe and a female half or box end that is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubulars, such as drill pipe, drill collars, and casing are suspended in the hole from the rig floor. A kelly is used as a top tubular member in the drill string, and the kelly passes through the rotary table and is acted upon by the rotary table to apply torque through the drill string to the bit. Fluid or mud pumps are used for circulating drilling fluid or mud intermediate the drilling rig and the bottom of the wellbore. Normally, the drilling fluid is pumped down the drill string and out through the drill bit, and is returned to the surface through the annulus formed about the drill string. The drilling fluid serves such purposes as removing earth cuttings made by the drill bit from the wellbore, cooling the bit, and lubricating the drill string to lessen the energy required to rotate the drill pipe. In completing the well, casing is normally run thereinto and is cemented to maintain the casing in place.

As previously mentioned, in the drilling of wellbores utilizing rotary drilling equipment, problems known as differential sticking of the drill string are sometimes encountered. These problems become more severe in drilling deviated wellbores, particularly in extended reach drilling, inasmuch as the drill string lies on the bottom of the deviated portion of the wellbore and drill cuttings tend to settle about the drill string. Because the drill string and cuttings lay along the bottom of the deviated portion of the wellbore, that portion of the annulus that lies above the drill string serves as the main stream for the flow of the drilling mud and cuttings to the surface of the earth.

Referring to the drawings in detail, particularly with reference to FIG. 1, a deviated wellbore 1 has a vertical first portion 3 which extends from the surface 5 of the earth to a kick-off point 7 and a deviated second portion 9 of the wellbore which extends from the kick-off point 7 to the wellbore bottom 11. Although the illustrated embodiment shows a wellbore having a first vertical section extending to a kick-off point, the teachings of the present invention are applicable to other types of wellbores as well. For instance, under certain types of drilling conditions involving porous formation and large pressure differentials, the teachings herein may be applicable to vertical wellbores. Also, some deviated wellbores need not have the first vertical section illustrated in FIG. 1.

A shallow or surface casing string 13 is shown in the wellbore surrounded by a cement sheath 15. A drill string 17, having a drill bit 19 at the lower end thereof, is positioned in the wellbore 1. The drill string 17 is comprised of drill pipe 21 and the drill bit 19, and will normally include drill collars 23. The drill pipe 21 is comprised of joints of pipe that are interconnected together by tool joints 25, and the drill string may also include wear knots therealong for their normal function. The tool joints 25 in the deviated second portion 9 of the wellbore normally rest on the lower side 27 of the wellbore, and support the drill pipe 21 above the lower side of the wellbore.

In drilling of the wellbore, drilling fluid (not shown) is circulated down the drill string 17, out the drill bit 19, and returned via the annulus 29 of the wellbore to the surface 5 of the earth. Drill cuttings formed by the breaking of the earth by the drill 19 are carried by the returning drilling fluid in the annulus 29 to the surface of the earth. These drill cuttings (not shown) tend to settle along the lower side 27 of the wellbore about the drill pipe 21.

In accordance with the teachings of the present invention, the tendency of the drill string to stick in the hole is reduced by vibrating it at a suitable frequency and amplitude to reduce the friction of the drill string against the lower side of the borehole. This promotes free movement of the drill string in the boreholes, and further mitigates the possibility of differential sticking of the drill string in the hole.

In a first embodiment of the present invention, the drill string is vibrated with a plurality of hydraulically driven vibrators in subs 31 located at spaced positions along the drill string, with the hydraulically driven vibrators being powered by circulating drilling mud.

Subs (short for substitutes) are special devices that are threaded so that they may be attached to and made a part of the drill string, and normally are used to perform some specialized function. In the present invention, each sub includes a hydraulically driven motor and a vibrator powered by the motor. Downhole motors are well known in the art, and normally include turbine blades which are powered by the circulating mud. Alternatively, downhole motors are known which include a multicurved steel shaft which turns inside an elliptically shaped housing opening. Drilling mud flowing through the downhole motor in each sub 31 causes the turbine blades or the multicurved shaft to turn, which in turn powers or actuates a vibrator. Each vibrator may be simply an eccentric, unbalanced weight on the output shaft of the downhole motor positioned to vibrate the drill string along its length. In a preferred embodiment, the particular downhole motors and the rate and pressure of circulation of the drilling mud may be selected to vibrate the drill string at its resonant or natural frequency.

Figure 2:
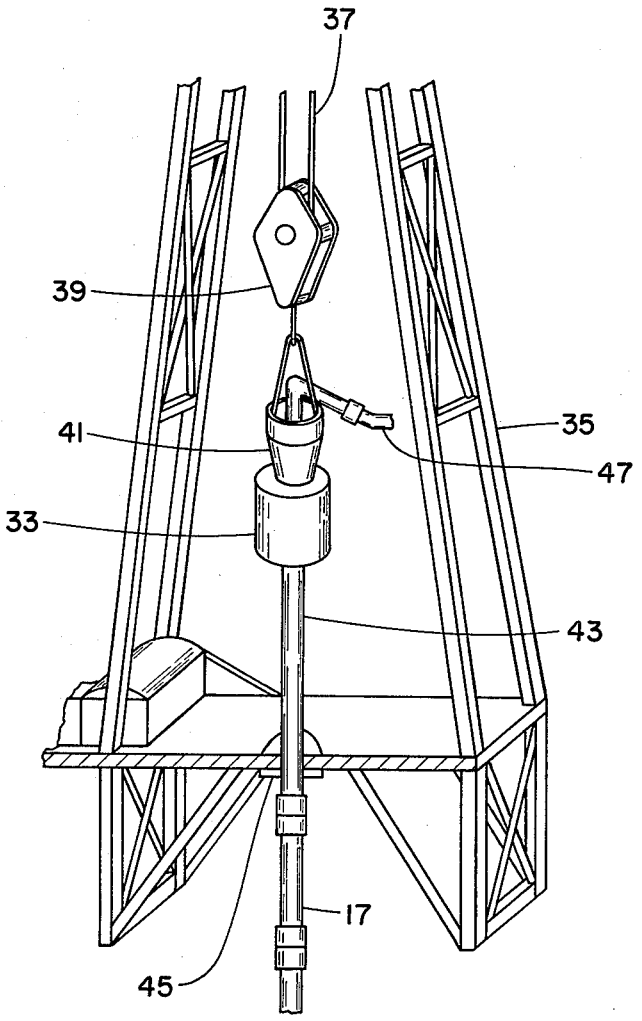
FIG. 2 is a perspective view of a rotary drilling operation at the top of the wellbore, and illustrates a second embodiment of the subject invention.

FIG. 2 illustrates a perspective view of a rotary drilling operation at the top of a wellbore, and shows a second embodiment of the present invention wherein a mechanical vibrator 33 is attached to the top of the drill string. The illustrated apparatus includes the general combination of equipment normally required in the rotary drilling of a borehole in an earth formation. Derrick 35 may be any one of numerous types of fixed or portable towers. Suspended over pulleys, not shown, positioned at the upper end or top of derrick 35 are a plurality of cables 37 which support a traveling block 39. Suspended from the traveling block is a swivel 41, to the lower end of which is secured the mechanical vibrator 33 and a kelly 43 which supports the drill string 17. Kelly 43 is square of hexagonal in cross section over a substantial portion of its length and fits in sliding relation through rotary table 45 situated in the floor of derrick 35. The rotary table, which is actuated by power elements, not shown, serves to turn the kelly, rotating the drill string. Due to the sliding fit between the kelly and the rotary table, as drilling progresses the kelly is allowed to slide downwardly through the rotary table. While the power for rotating the kelly and thus the drill string is applied to the rotary table, the entire weight of the kelly and drill string is supported by swivel 41 which also functions to conduct drilling fluid to the kelly and drill string. Drilling fluid passes through hose 47 into the swivel. The mechanical vibrator 33 may be powered by any of the sources of power normally available at a drilling site, and the vibrator may again be simply an eccentric unbalanced weight positioned to vibrate the drill string along its length. Alternatively, the vibrator may be of the type disclosed by Brooks U.S. Pat. No. 3,234,014 which is integrated into the structure of the swivel. However the frequency of an electrically driven vibrator is relatively easy to control, which appears to make it a very suitable choice. As the length and nature of the drill string changes during a drilling operation, its natural or resonant frequency will also change, and an electrically driven mechanical vibrator is easily controllable in frequency.

While several embodiments of the present invention are described in detail herein, it should be apparent to one of ordinary skill in the rotary drilling arts, that the present disclosure and teachings will suggest many other embodiments and variations to the skilled artisan. For instance, the embodiments of FIGS. 1 and 2 may be combined in a third embodiment, and also different types of vibrators may be implemented in various embodiments of the present invention.

What is claimed is:

1. A method of rotary drilling a wellbore in extended reach drilling into the earth in a manner to mitigate sticking of a drill string having a drill bit at the lower end thereof, comprising drilling said wellbore by rotating a drill string comprised of sections of drill pipe connected together, and mitigating the tendency of the drill string to stick in the hole by continuously vibrating the drill string with a mechanical vibrator attached to the top of the drill string at a frequency and amplitude to reduce the friction of the drill string against a side of the borehole and promote free movement of the drill string therein, whereby sticking of the drill string in the hole is mitigated.

2. A method of rotary drilling a wellbore as claimed in claim 1 wherein said step of drilling includes the step of drilling a hole having an inclination from a vertical of at least 60°.

3. A method of rotary drilling a wellbore as claimed in claim 1 or 2, wherein said step of vibrating includes vibrating the drill string at the resonant frequency of the drill string.

4. The method of claim 3 wherein said frequency of said mechanical vibrator is adjusted as the length of said drill string changes to maintain vibration of the drill string at its resonant frequency.

* * * * *